United States Patent [19]

Jennings

[11] 4,002,369

[45] * Jan. 11, 1977

[54] CHAIR AND METHOD OF MAKING SAME

[75] Inventor: Roy E. Jennings, Temple, Tex.

[73] Assignee: Royal Seating Corporation, Cameron, Tex.

[ * ] Notice: The portion of the term of this patent subsequent to Oct. 11, 1992, has been disclaimed.

[22] Filed: Mar. 17, 1972

[21] Appl. No.: 235,673

Related U.S. Application Data

[63] Continuation of Ser. No. 198,175, Nov. 12, 1972, abandoned.

[52] U.S. Cl. ..... 297/445; 108/91; 108/155; 211/182; 248/188.1; 248/188.2; 297/239; 297/DIG. 2

[51] Int. Cl.[2] ..... A47C 3/04; A47C 3/20; A47C 5/12

[58] Field of Search ..... 297/440–445, 297/433, 439, 460, 248, 239; 248/188.1, 188.8, 165, 445.1; 182/178, 179; 108/153, 111, 101, 155, 157

[56] References Cited

UNITED STATES PATENTS

| | | | |
|---|---|---|---|
| 1,995,383 | 3/1935 | Fischer | 211/182 |
| 2,588,417 | 3/1952 | Schladermundt et al. | 297/DIG. 2 |
| 2,780,431 | 2/1957 | Carlson | 248/188.1 |
| 2,795,844 | 6/1957 | Liszak | 248/188.8 |
| 2,884,296 | 4/1959 | Meilinger et al. | 312/111 X |
| 3,030,728 | 4/1962 | Wesman | 248/345.1 |
| 3,053,558 | 9/1962 | Challas et al. | 312/111 |
| 3,159,423 | 12/1964 | Gilbert | 108/156 X |
| 3,257,148 | 6/1961 | Menuto | 297/433 |
| 3,361,088 | 1/1968 | Hodgkin | 108/153 X |
| 3,406,786 | 10/1968 | Lang | 248/165 |
| 3,422,584 | 1/1969 | Howard | 52/98 |
| 3,610,686 | 10/1971 | Caruso | 297/445 |
| 3,620,567 | 11/1971 | Hendrickson | 297/248 |
| 3,639,001 | 2/1972 | Anderson | 248/188.8 |
| 3,669,497 | 6/1972 | Massonnet | 297/460 |
| 3,698,150 | 10/1972 | Anderson | 297/445 |

FOREIGN PATENTS OR APPLICATIONS

| | | | |
|---|---|---|---|
| 1,178,652 | 5/1959 | France | 248/165 |
| 1,385,736 | 2/1975 | United Kingdom | 108/153 |

*Primary Examiner*—Casmir A. Nunberg
*Assistant Examiner*—Carl F. Pietruszka
*Attorney, Agent, or Firm*—Joseph F. Brisebois; Walter Kruger

[57] ABSTRACT

A plastic chair which is assembled from only several unitary pieces, some of which can be identical to each other. The chair seat takes the form of a unitary seat-back shell of molded plastic material. The base structure takes the form of two molded plastic pieces having male and female connecting portions to permit joining the pieces of the base merely by fitting them together. Connecting flanges on the seat-back shell permit securing the seat to the connecting portion of the base. The base pieces are secured together by ultrasonic welding and the seat is ultrasonically welded to the base. The method of making the chair includes molding the several pieces from a colorant containing plastic and securing the pieces together. Each leg includes a plurality of webs to permit cutting the legs so a chair of a desired height is obtained while simultaneously obtaining floor engaging glides. Strengthening ribs and rigidity to the chair, and the plastic can include glass fiber reinforcing for additional strength.

10 Claims, 10 Drawing Figures

CHAIR AND METHOD OF MAKING SAME

This application is a continuation in part of my copending application Ser. No. 198,175, filed Nov. 12, 1972, and now abandoned.

This invention relates generally to chair and other furniture constructions, particularly a chair for school room or nursery school use, and to a method of making the chair.

In addition, the invention relates to a base structure which is particularly useful for supporting a chair seat, but which can also be used to support other structures such as a tabletop, or can be used along to support a desired object, and to a method of making and assembling the base structure.

More specifically, the invention relates to a chair formed from a base and a seat-back in which the seat-back takes the form of a unitary structure formed from a plastic material which may be internally reinforced but which has exposed surfaces that are wholly plastic and of any desired coloration. Similarly, the base parts are formed from a plastic material which, again, can be internally reinforced but which has wholly plastic material exposed surfaces which can be of any color. The base parts and the seat are formed from a plastic material having suitable characteristics for securing the several parts together by welding, advantageously, by the technique of ultrasonic welding.

School room or educational furniture is uniquely different from other types of household and business furniture. School room furniture must necessarily be quite rugged to withstand the rough treatment of the furniture by school age children. The furniture must be available in different sizes to accommodate the various age groups of school children. Another important requirement of school furniture is that it must be easy to clean and sanitize and must not contain materials which can support bacterial or insect growth. In addition, the school furniture must be comfortable so the student's attention will be maintained on classroom activities rather than his uncomfortable chair.

From the standpoint of the manufacturer, the desirable features of classroom furniture are durability, economy of manufacture, economy of shipment, appearance, and comfort. Since an attractive chair enhances the atmosphere of the classroom, appearance is certainly a primary consideration to the manufacturer with regard to the sale of the product. With regard to economy of manufacture, simplicity is a primary consideration since the less complex the construction is, the less expensive it will be to manufacture the chair or other article. Where the chair is of simple non-complex construction, the cost of tooling is correspondingly reduced.

Not to be overlooked by the manufacturer is the comfort of the chair. Comfort in a chair, while not considered important in the past, is becoming increasingly significant because of the recent realization that there are fewer disciplinary problems and that student's grades are better where the student is comfortable in the chair in which he sits for perhaps 6 hours each day.

With regard to economy of shipping, it is desirable that the chair or other furniture be so constructed that like articles are nestable for shipping to reduce both the volume of the space required for shipping the chairs, as well as the amount of carton material for packing the chairs.

By virtue of the requirements of educational furniture, explained above, such furniture which has been available in the past has not been inexpensive. In the case of chairs, such chairs have in the past been constructed with at least several metal parts such as tubular metal legs which are welded to a support which in turn is secured to the chair seat. While such a construction is quite durable and has been adopted by many manufacturers, the chairs are not inexpensive because of the number of manufacturing operations required to construct the chair, and because it is also necessary to paint the metal parts of the chair.

The technique of making the chair of this invention includes forming the seat structure, forming the parts from which the base structure is assembled, and joining the parts to form the assembled chair. The forming of the seat structure is advantageously accomplished by molding the seat-back as a unitary structure for example, by casting or by the well known injection molding technique. The seat-back can, however, be formed, if desired, by any other molding or forming technique which results in a seat of unitary construction, and advantageously in which the finished structure is colored with a pigment or colorant dispersed in the plastic at the time the structure is formed so there is no need for painting the parts after manufacture. Similarly, the pieces or parts from which the base is formed are molded, for example, by an injection molding technique, and the plastic material from which these pieces are molded has a colorant mixed therein so the manufactured pieces require no painting either before or after assembly. In accordance with the preferred embodiment of the chair and its method of manufacture, the chair is of three part construction including a unitary seat-back and first and second base parts which can be identical to reduce tooling costs.

A unique feature of the legs of the base is that these legs are adapted to be shortened by severing the legs to the same length at one of several different locations so the same chair can be used for children of different age groups. Advantageously, the legs are so formed initially, that the legs can be cut off at at least several different locations along their length while still providing integral floor engaging glides so it is unnecessary to use separate add-on type glides after the legs are severed to the desired length. The base parts are so formed that in the region of the portion of the base which supports the seat there are wall portions of the base parts which overlap wall portions of adjacent base parts when these parts are arranged to form the base. The overlapping wall portions facilitate joining the base parts together to form the base structure and also facilitate securing the seat to the base structure to form a durable chair. The securing of the several parts together can be accomplished by the technique of ultrasonic welding which produces joints which are as strong as the plastic material of the joined parts or by other suitable securing means.

In the preferred embodiment the base is formed from two parts each of unitary construction and which have respectively, wall portions adapted to overlap such that substantial lengths of these wall portions are in face to face relationship with each other. The wall portions of the respective base pieces can be arranged to slip fit one into the other and can be suitably reinforced by strategically located reinforcing ribs to provide a composite base structure which is at least as strong as a one piece molded base. Because of the necessary draw required to remove the base parts from the mold in which they are formed, reinforcing ribs can be more appropriately located where the base is formed from several parts then where the base is a single molded part. To form a single part with the same reinforcing ribs would require an extremely complicated and expensive four or perhaps six piece mold in order to be able to remove the piece after it is molded.

By virtue of the precolored plastic material from which the several parts of the chair are formed, and the technique of bonding or welding the parts together to form the assembled chair, there are no exposed metal parts which either require painting or which are subject to corrosion. Correspondingly, the chair can be used under virtually any conditions within the range of temperature stability of the plastic material from which the chair is formed. Since the chair is completely corrosion proof and since the plastic material is also completely water proof the chair can be used in areas of the country with virtually any atmosphereic conditions and can even be used on beaches or boats since it is impervious to moisture and corrosion.

While the molded plastic parts can be reinforced with a material such as glass fibres dispersed in the plastic material from which the chair parts are formed, such reinforcing material is usually not required because of the strategic location of reinforcing and bracing ribs in the chair parts of this invention.

Correspondingly, an object of this invention is a chair formed from only several parts, which parts are of simple construction and can readily be constructed by known plastic material forming techniques, which is simple to assemble and extremely sanitary because exposed parts of the assembled chair are of plastic material and the colorant is molded into the chair so there are no paint flaking problems.

Another object is a chair constructed from only several plastic material pieces including base parts having wall portions adapted to be assembled with the wall portions in overlapping relation to facilitate securing the parts together at the overlapping sections of the wall portions by any suitable means such as bonding or welding or using separate fasteners such as plastic rivets.

A further object is a chair including a base structure formed from only two identical parts having wall portions arranged to interfit and to be secured together to form a rigid base structure for supporting a chair or other object.

A further object is a supporting base for a chair which is formed from only several plastic material pieces, each piece having at least one leg integral with rail sections of the piece and in which the several pieces from which the base structure is formed each include reinforcing ribs at selected locations along the legs and rails to add rigidity to the base structure.

A further object is a base structure formed from only several parts adapted to be arranged in opposed relation to each other and secured together to form a substantially wholly plastic material supporting base for a chair or other object.

A further object is a unitary leg which can be used as a chair leg and which includes a plurality of glide forming elements integral with the leg, in which severing the leg at any one of several locations along its length provides a floor engaging glide, and in which strengthening ribs on wall portions of the leg serve to add rigidity to the leg.

A still further object of the invention is a three piece chair which is structurally sound, is hygienically sanitary, is of wholly plastic material construction, is formed from plastic material parts which require minimum finishing, is of light weight, and is inexpensive to manufacture.

Numerous other objects, features and advantages of this invention will become apparent with reference to the accompanying drawings which form a part of the specification and in which.

Figure 1:
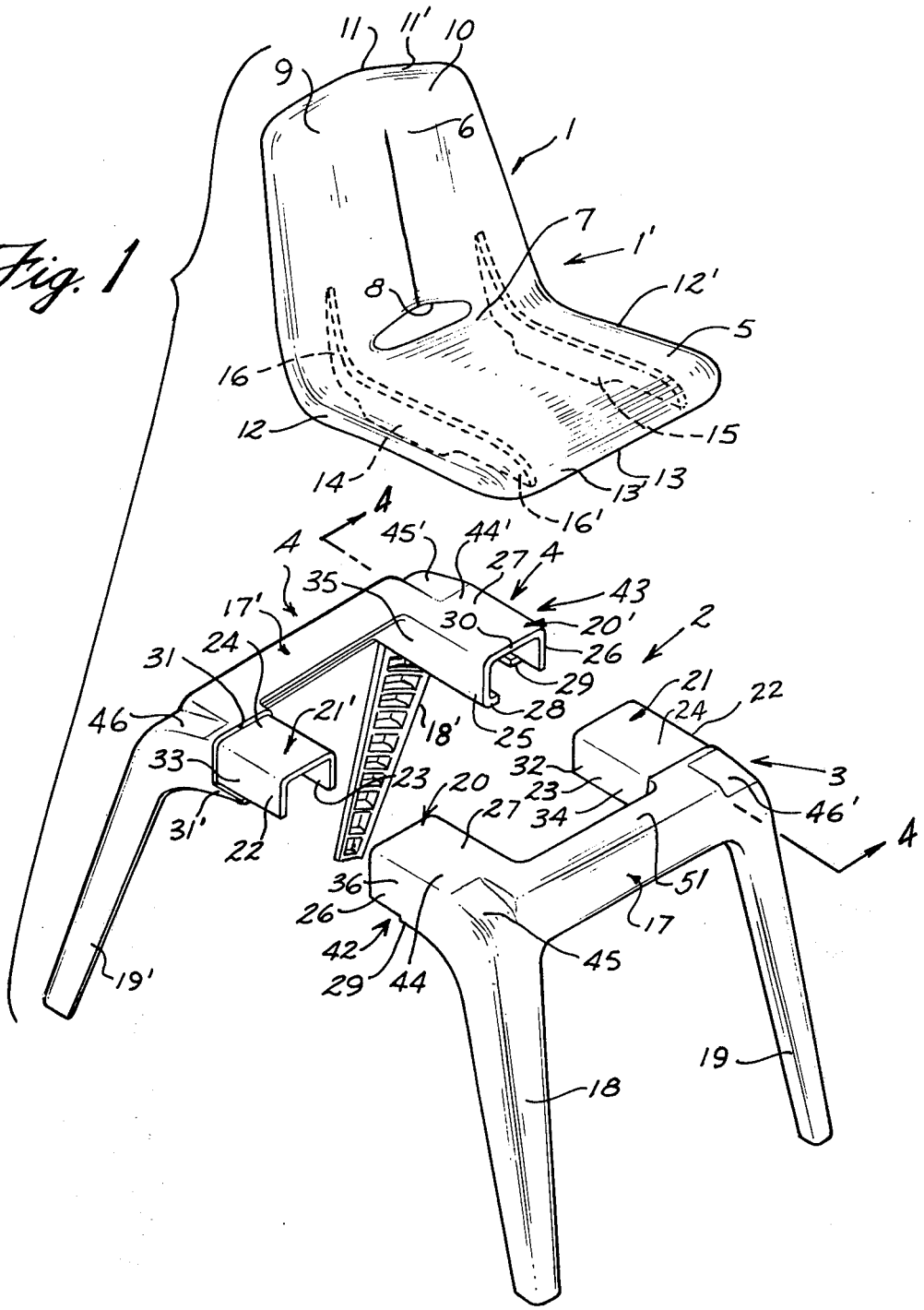
FIG. 1 is an exploded pictorial view of the chair of this invention.

Referring now to the drawings in detail and particularly to FIG. 1 there is shown the chair of this invention and the manner in which it is assembled from its component parts. Chair 1 comprises a unitary seat-back shell 1 and a supporting base 2 composed of only two base pieces or sections 3 and 4. Because of their location relative to seat 1, these base pieces are termed a front base piece 3 and a rear base piece 4. Each base piece is of unitary construction and is advantageously molded from a relatively rigid plastic material for example, high density polypropylene containing a suitable colorant or pigment. While base pieces 3 and 4 have been designated by different numerals for purposes of explanation, these base pieces are identical to each other and base piece 3 is merely base piece 4 rotated 180° about a vertical axis.

Seat-back shell 1 is integrally molded to provide a unitary seat-back shell. The seat-back shell includes a seat portion 5 and a back rest portion 6. The rear 7 of the seat 5 is of shallow concave curvature for comfort of the person seated in the chair. At the bottom of the back rest 6 is a triangular buttocks relief opening 8 which cooperates with the sloping surfaces 9 and 10 of the back rest to provide a chair of improved comfort. The surfaces 9 and 10 are essentially planar and form a shallow V-shaped back rest. The angle between the surfaces 9 and 10 increases in a direction toward the top edge 11 of back 6. It has been found that such a construction provides comfort for the occupant of the chair.

As shown in FIG. 1, seat-back shell 1 has side flanges 12 and 12' which extend from top flange 11' at the top 11 of the back to front flange 13' of the front 13 of the seat. In the region of the back each flange extends rearwardly, then generally follows the curvature at the juncture of seat 5 and back 6, and then extends downwardly from the side edges of seat 5.

Figure 3:
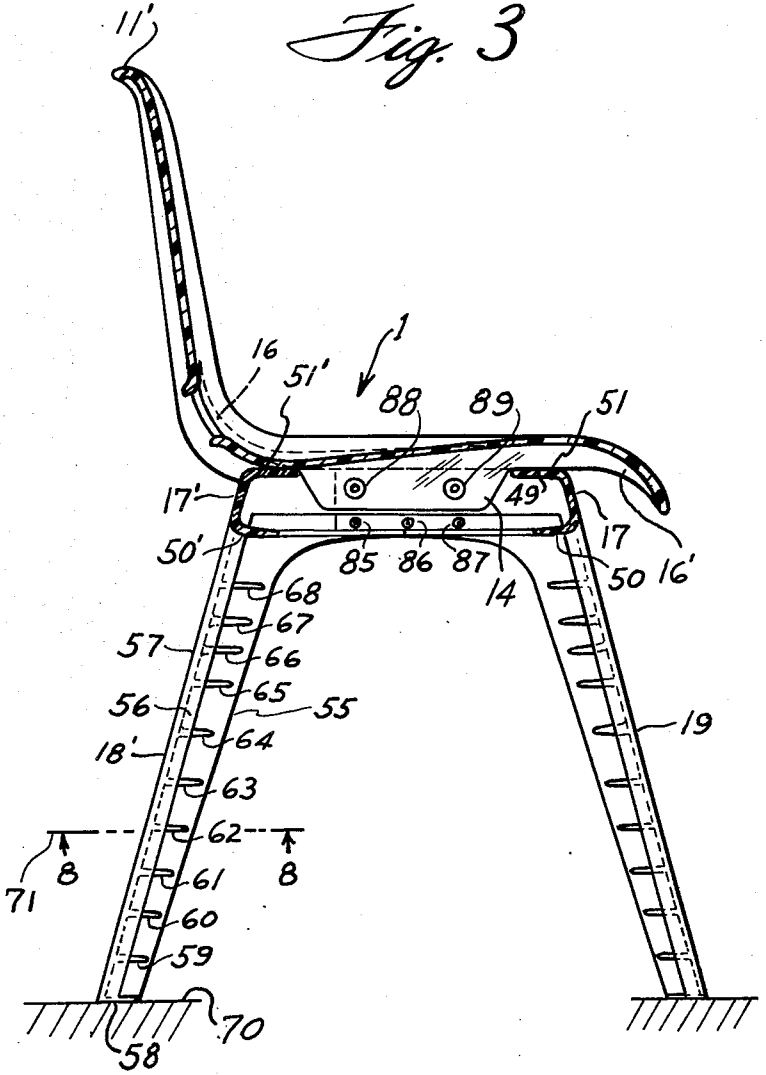
FIG. 3 is a side view in section taken along line 3—3 of FIG. 2.
Figure 2:
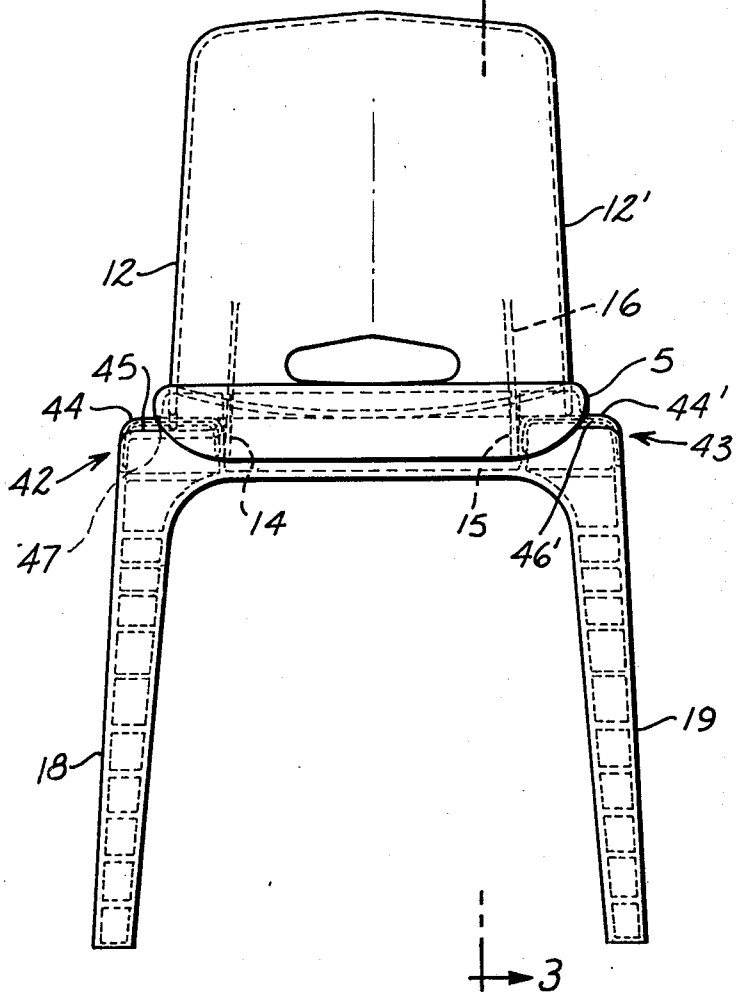
FIG. 2 is a front view of the assembled chair.

As shown at FIGS. 1, 2, and 3, parallel connecting flanges or walls 14 and 15 project downwardly from the underside of seat 5 and are provided to connect seat-back shell 1 to base structure 2. Each of flanges 14 and 15 is elongated in a direction fore and aft of seat-back shell 1. The flanges are integrally molded with the seat-back shell and each includes a rearwardly extending strengthening rib portion 16 which projects rearwardly, extends around the curvature at the junction between the seat 5 and back 6, and extends upwardly along back 6. In addition, each connecting flange has a front reinforcing rib portion 16′ which projects forwardly from the flange and has a configuration the same as the side flange 12 adjacent the front of seat 5. The front and rear rib portions are each of substantial height to add rigidity to the seat along the junctures of the seat 5 and back 6 as well as to the front portion of seat 5. Connecting flanges 15 and 16 are generally parallel with each other for a reason which will subsequently be described, whereas side flanges 12 and 12′ of the seat-back shell converge in a direction away from front 13 of the seat.

Base pieces 3 and 4 are identical. Base piece 3 includes a front rail 17 which connects together a pair of spaced apart front legs 18 and 19. Front legs 18 and 19 each slope away from each other in a direction downwardly away from seat 5, as shown at FIG. 2. In addition, as shown at FIG. 1, legs 18 and 19 are inclined rearwardly. Extending rearwardly from the junction of leg 18 with front rail 17 is a female rail section 20, and extending rearwardly from a location adjacent the junction of leg 19 and front rail 17 is a male rail section 21. Rails 20 and 21 are parallel to each other and perpendicular to front rail 17.

Similarly, in the case of base piece 4 there are rear legs 18′ and 19′ joined by a rear rail 17′. Extending forwardly from the juncture of rear rail 17′ and leg 18′ is a female rail section 20′ and extending from the juncture of rear rail 17′ and leg 19′ is a male rail section 21′. To join base pieces 3 and 4 it is merely necessary to align these base pieces as shown at FIG. 1 and then slide them together so male rail 21 is within female rail 20′ and male rail 21′ is within female rail 20.

Male rails 21 and 21′ are each of box-like construction with an open bottom, being composed of an outer side wall 22, an inner side wall 23, and a top horizontal wall 24 which joins the side walls across their top edges. Similarly, female rails 20 and 20′ are generally box-shaped, being composed of upright side walls 25 and 26 joined by a top horizontal wall 27. Projecting toward each other from the bottom edges of the respective side walls 25 and 26 are elongated narrow flanges or lips 28 and 29 respectively which add beam strength to the side rails formed by the respective partial rails when the base pieces are fitted together. Lip 29 terminates in spaced relation to the end of rail 20′ and extends along the lower outside edge of wall 22, for approximately ½ the length of the wall. Beam strength is obtained because the height of each of side walls 22 and 23 is of the same height as opening from the upper surface of flanges 28 and 29 to the lower surface of top wall 27 of the female rails 20′. Hence, when the male portions are slipped into the female portions the side rails thus formed are rigid and of substantial strength. Engagement of end edges 30 of the respective top and side walls of the female portions 20′ with the abutment shoulder 31 at the origin of each male rail 21′ limits the distance that the male portions can be inserted into the female portions and provides a smooth joint at the visible exposed surfaces of the base.

Figure 4:
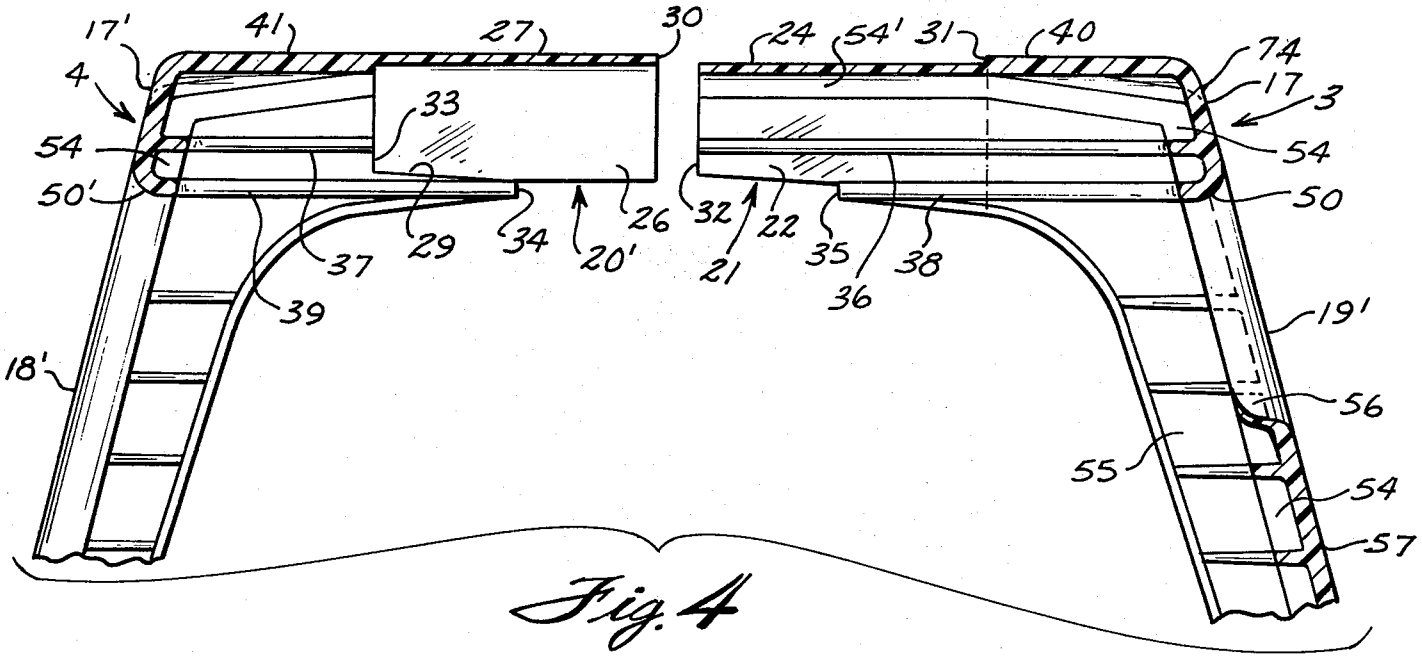
FIG. 4 is a view in section taken along line 4—4 of FIG. 1 and showing portions of the base pieces and the details of the interfitting rails.
Figure 5:
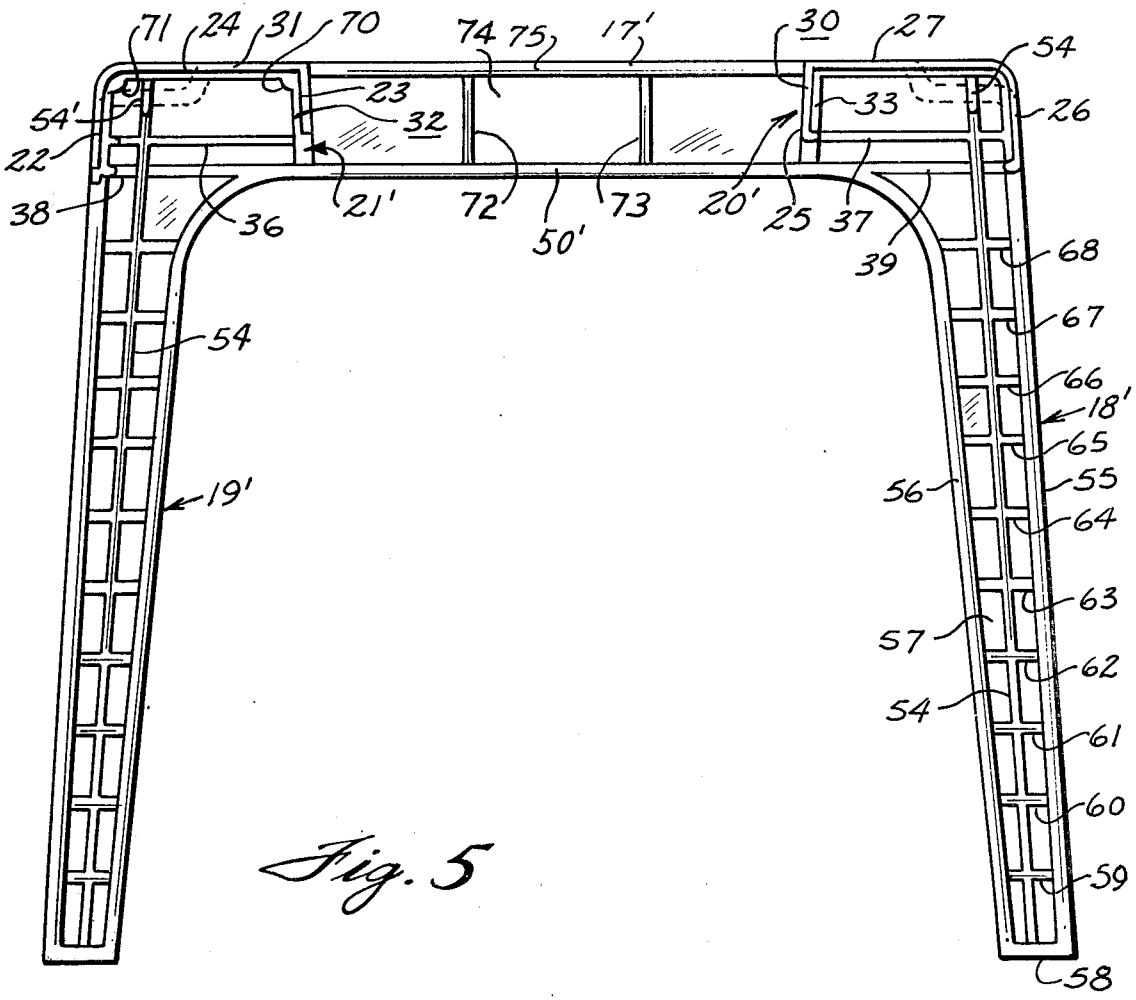
FIG. 5 is a front view in elevation of one of the base pieces.
Figure 6:
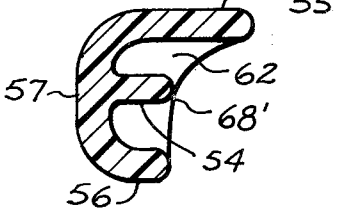
FIG. 6 is a partial view in section taken along line 6—6 of FIG. 3.

Attention is now directed to FIGS. 4 and 5 which show the male rail and female rail in greater detail and also show the location of strengthening ribs on these rails. From FIG. 4 it is apparent that when the base is assembled by sliding male rail 21 into female rail 20′, end edge 30 of the female rail abuts shoulder 31 of the male rail. In addition, end edge 32 abuts the shoulder 33 at the inner end of the female rail 20′. The end edge 34 of lip 29 is then in abutting relationship with the end edge 35 of a lip of male rail 21.

As shown at FIGS. 4 and 5 each male rail has a horizontal strengthening rib 36 which extends along the inner surface of wall 22 and which continues along the inside of the wall which forms front rail 17. Female rail 20′ has a similar strengthening rib 37 similar to the rib 36 which extends horizontally along the inside surface of the rail but terminates at shoulder 33. As is apparent with reference to FIG. 4, rib 37 extends along a portion of rear rail 17′.

A horizontal reinforcing rib 38, parallel with and below rib 36, of male rail 21 extends along the inside surface of wall 22 and is a continuation of the lip 50 of front rail 17. Female rail 20′ has a similar rib 39 which extends along the inside surface of wall 26 and is a continuation of the lip 50′ of rear rail 17′.

As is apparent with reference to FIG. 4, the wall portions of male rail 21 and female rail 20′ into which the male rail slides have a thickness which is only one half the thickness of the material beyond the rails for example, at the sections 40 and 41 of the respective male and female rails. As for an example, top wall 24 of male rail 21 is only one half the thickness of section 40 and top wall 27 of female rail 20′ is only one half the thickness of section 41.

It is to be appreciated that the outside dimensions of each male rail are such that the male rail is snugly received in the female rail, when the front and rear sections 3 and 4 of the base are moved together from the position of FIG. 4 to the position shown at FIG. 3. With the base pieces 3 and 4 assembled, these pieces are then secured together in a manner which will subsequently be described in detail.

With the base pieces assembled the male and female partial rails at one side of the chair form a side rail 42, and the male and female partial rails at the other side of the chair form a side rail 43 (FIGS. 1 and 2). The side rail 42 presents a horizontal top surface 44 with a forwardly inclined front surface 45 at the top of front leg 18. At the rear of side rail 42 is a rearwardly sloping rear surface 46 at the top of rear leg 19′. At side rail 43 there is similarly a top horizontal surface 44′, a sloping surface 45′ at the top of rear leg 18′ and a sloping surface 46′ at the top of front leg 19. As shown at FIG. 3, for the side flange 12, the bottom edge 47 of this flange is configured to rest on top surfaces 44 and 46 of side rail 42. As shown at FIG. 3, rear strengthening rib 16 of each connecting flange engages rear rail 17′. The bottom edge 49 of the front ribs 16′ of the connecting glanges rests on front rail 17. The connecting flanges 14 and 15 engage the inner edges of the front and rear rails. By virtue of these several areas of engagement between the base and the seat-back shell, substantial weight can be supported by the assembled chair without substantial stresses on either the base structure or the connecting flanges 14 and 15.

As is apparent with reference to FIGS. 1 and 2, top surfaces 51 and 51' of the front and rear rails 17 and 17' respectively lie in the same horizontal plane when base structure 2 is assembled.

The construction of the legs of the base is also unique. As shown in FIGS. 1, 4, and 5 for the leg 18', each leg is tapered and has a side wall 55, an inner wall 56, and a curved connecting wall 57 which joins the side wall with the inner wall. Inner wall 56 is generally parallel with side wall 55, although it is apparent that these walls diverge in a direction toward the top of base structure 2. There is also an intermediate wall 54 which extends from the bottom of the leg 18' to the inside of female rail 20' and along the rail where it ends at shoulder 33 (FIG. 4). Intermediate wall 54 has a depth approximately equal to the depth of connecting wall 57, and wall 54 functions as a reinforcing rib to add rigidity to the base structure.

Integral with walls 54–57 are a plurality of flat gusset-like webs 58–68. Each of the webs is integral with each of walls 54–57, and the inner edge 68' of each web is of concave curvature from wall 56 to wall 55, as shown at FIG. 5 for the web 62. Webs 58–68 are combined brace or strengthening and glide forming webs which permit severing leg 18' at one of several locations while providing an integral floor engaging glide. At least the bottom surface of each of webs 58–68 is parallel with the surface or floor 70 on which the chair rests. Correspondingly, webs 58–68 are parallel with each other. The webs 58–68 are spaced apart from each other a predetermined distance, for example, 1 inch, to enable severing the leg horizontally in the plane of the bottom surface of a selected web, for example, the web 62 provide a chair of a desired height. Severing leg 18' horizontally at line 71 (and severing the other legs 18, 19 and 19' at the same location) provides a chair which is approximately 3 inches lower than the chair shown at FIG. 3. By severing the legs along the bottom of the same web of each leg floor engaging glides integral with the respective legs are simultaneously provided. There is no need for separate add-on type glides. Such provision for severing the legs and automatically providing floor engaging glides permits using the same chair but with the legs severed at different locations for children or students of different age groups. Hence, the same basic chair can be used for children of different age groups merely by severing the legs at the predetermined desired locations while simultaneously exposing the bottom surfaces of the webs to provide integral floor engaging glides.

Hence, the only additional cost involved to provide a chair suitable for children of different age groups is the step of severing all four legs of the chair along the bottom surface of the same web, such as the web 62. Since the exposed bottom surface of the web forms the floor engaging glide, no additional separate glide is necessary. The webs 63–68 remaining when the legs are severed for example at web 62, provide additional strength for the legs. Where the chair is to be used with pre-school children in the 3 year old age group, it may be desirable to sever all four legs along the bottom of web 64 to provide a very low chair.

Figure 7:
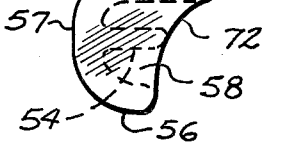
FIG. 7 is a partial bottom view of the chair leg showing the integral glide.

FIG. 7 shows the bottom of leg 18' and also shows that the configuration of web 58, which is the floor engaging glide, when it is not necessary to sever the legs to lower the chair. It will be observed that glide 58 is flush with the bottom of walls 55–57 of the leg, and that the inner edge 72 of the glide has a concave curvature similar to the curvature of the edge 68' of web 62, as shown at FIG. 5.

Figure 8:
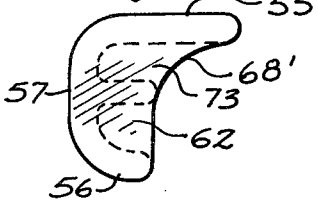
FIG. 8 is a view looking from the bottom and showing the glide formed when a leg is severed at a glide forming web.

FIG. 8 shows the bottom of leg 18' when the leg is cut in a plane parallel with the flat bottom surface of web 62. As is apparent, the floor engaging glide formed by the web 62 is slightly larger than the glide provided by the web 58, FIG. 7, but is of similar configuration and presents a flat bottom surface 73.

Referring now to FIG. 5 and the leg 19', is will be observed that leg 19' is an exact mirror image of leg 18' previously described. A slight difference exists, however, with regard to the manner in which the intermediate wall 54 of the leg 19' extends relative to male rail 21. As shown at FIGS. 4 and 5, the strengthening rib or intermediate wall 54 has an extension 54' along the bottom of top wall 24 so it extends to end edge 32 of the male rail. The arrangement is such that when the male rails are inserted into the female rails, the intermediate wall or strengthening rib 54 of the female rails is aligned with the extension 54' of the rib 54 of the male rails. Similarly, rib 36 aligns with rib 37 and rib 38 aligns with rib 39.

Additional strength along the rails is provided by the elongated beads or enlargements 70 and 71 at the juncture of side wall 23 with top wall 24 and side wall 22 with top wall 24 of the male rail. These beads or enlargements 70 and 71 extend the length of each male rail, originating at the end edge 32 and terminating at vertical wall 74 of the front or rear rails.

Additional strength is obtained from a pair of spaced apart vertical strengthening ribs 72 and 73 on the inside of the front and rear rails as shown at FIG. 5 for real rail 17'. The ribs 72 and 73 cooperate with lip 50', sloping wall 74, and top wall 75 of the front and rear rails to add rigidity to these rails.

METHOD OF MAKING THE CHAIR

Figure 9:
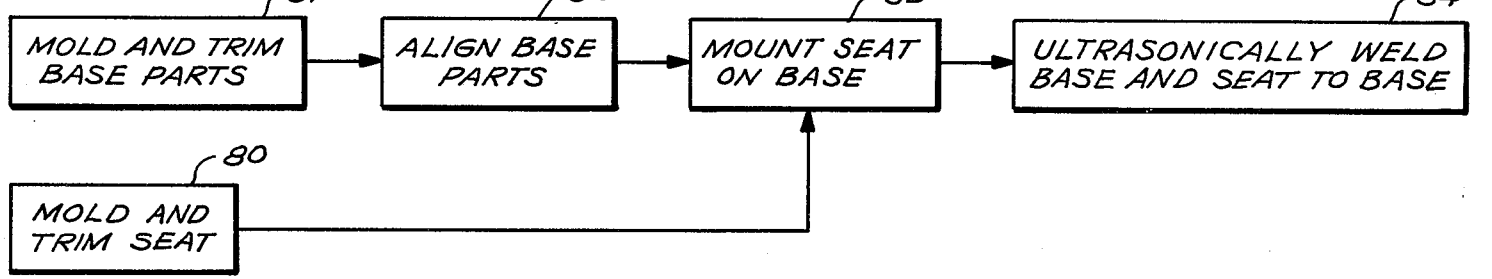
FIG. 9 is a block diagram showing a method of making the chair.

FIG. 9 shows in block form a preferred method for making the chair of this invention. The technique includes molding and trimming the seat as shown at 80. In addition, the base parts are molded and trimmed as shown at 81. The molding of both the base sections 3 and 4 and seat 1 is advantageously accomplished by the well known technique of injection molding into a closed mold, although it will be appreciated that the seat and base parts can also be cast. A preferred plastic material for both the base parts and the seat is high density polypropylene to which a colorant can be added prior to molding, so the molded pieces require no painting or finishing other than to merely trim flash and sprues from the molded pieces. While a copolymer such as high density polypropylene can be used to form the chair parts, other plastic materials such as high density polyurethane or high density polyethylene can also be used. Other plastic materials such as styrenes or virtually any other plastics which can be molded or cast can also be used to form the chair parts. If additional strength is required, short glass fibres can be mixed with the plastic material for example, by mixing such glass fibres with the plastic prior to molding or casting.

After the base parts are molded and trimmed, the parts are aligned as shown at FIG. 1 and are pushed together to seat the male rails 21 and21' fully within the female rails 20 and 20'. Next, seat 1 is positioned with its connecting flanges 14 and 15 engaging the outside surfaces of inner walls 25 of the respective female rails. These steps are shown in the blocks 82 and 83 of FIG. 9. Next, as shown at block 84 of FIG. 9, the base parts are ultrasonically welded together and the seat is ultrasonically welded to the base. This is accomplished with ultrasonic spot welding using ultrasonic spot welder of the type available from Branson Sonic Power Company, Danbury, Connecticut. The ultrasonic spot welding is preferably accomplished by engaging the tool with the inside of the walls 22 of the male rails while providing a backup element which engages the outside of wall 26 of the female rails. The tool is used to weld the walls at several locations such as the spots 85–87 of FIG. 3. In addition, top wall 24 of each male rail is spot welded to top wall 27 of each female rail by pressing the ultrasonic spot welding tool against the under surface of wall 24 of the male rail and welding at several locations while holding a backup tool against the upper surface of wall 27. Inner walls 23 and 25 of the respective female and male rails are similarly welded together, preferably simultaneously with the welding of the flanges 14 and 15 of the seat to the walls 25 of the female rails. This is accomplished by engaging the welding tool with the inside surfaces of the respective connecting flanges 14 and 15 while supporting the walls 23 and 25 with a backup tool in engagement with the inside surface of the wall 23 of the male rails. As shown at FIG. 3 the welding of the seat to the base is performed at several locations such as the spots 88 and 89. The spots 85–89 shown at FIG. 3 are impressions left in the plastic material as the result of the configuration of the tip of the tool which is engaged with the surface during welding.

While it is preferred to join the base sections and the seat using an ultrasonic spot welding technique, it is to be appreciated that the base parts can be secured together and that the seat can be secured to the base by bonding or by any other suitable securing means, including for example, rivets or any other suitable fasteners.

Figure 10:
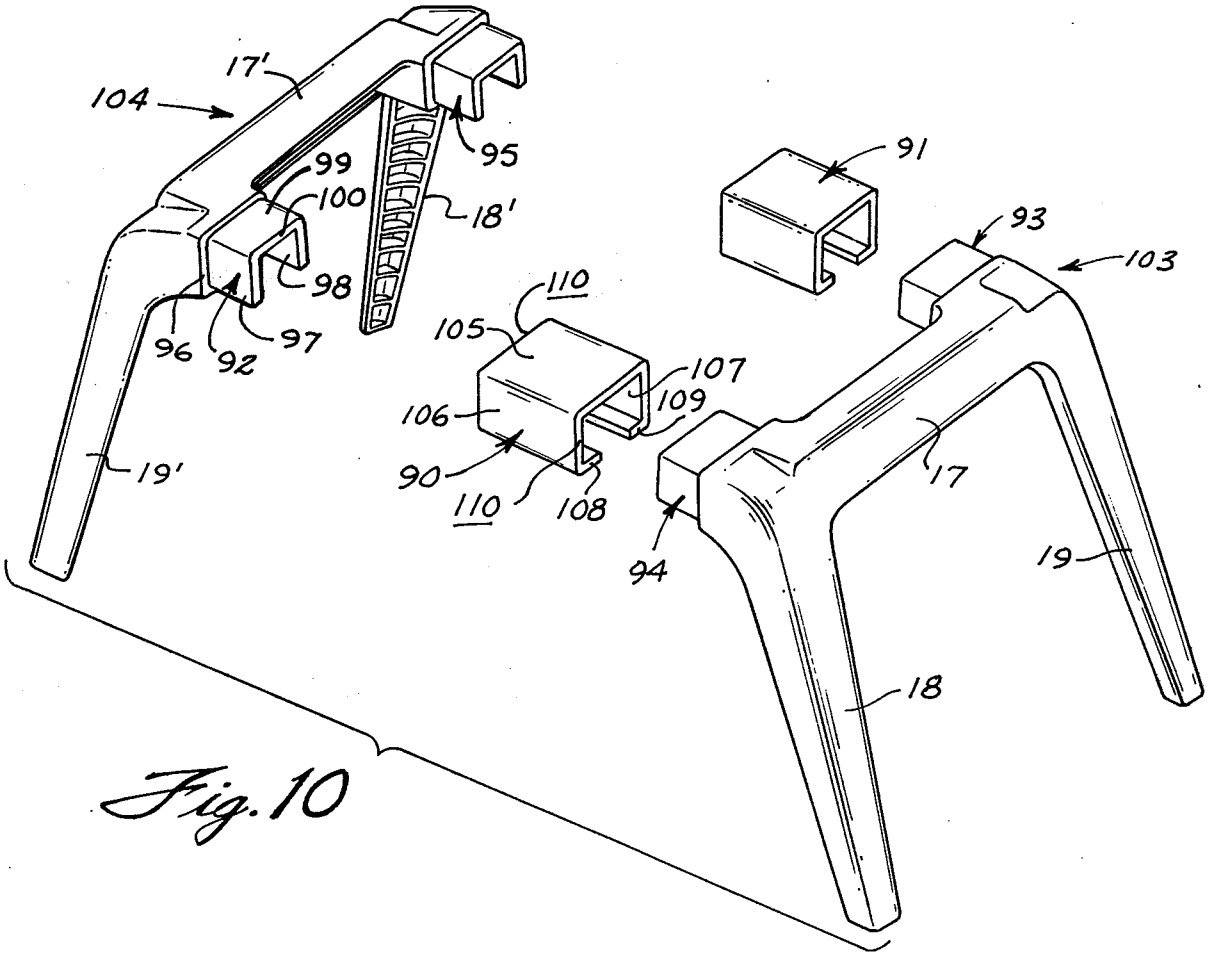
FIG. 10 is an exploded view of a second embodiment of the chair of this invention.

The embodiment of the base shown at FIG. 10 is substantially the same as the embodiment of FIG. 1 save that separate connector rails 90 and 91 are provided, the male rails 21 and 21' of FIG. 1 are shortened to provide male rails 92 and 93, and female rails 20 and 20' are eliminated and replaced by male rails 94 and 95 which are the same length as and identical to the rails 92 and 93. Otherwise, base section 103 is identical to base section 3 of FIG. 1 and base section 104 is identical to base section 4. As is apparent from FIG. 10 the respective sections have legs 18, 18', 19, 19', a front rail 17 and a rear rail 17' all identical to corresponding parts of the base sections previously described with reference to FIG. 1.

Each of the rails 92–95 terminates at a peripheral shoulder 96 (the tongue 31' of the embodiment of FIG. 1 being eliminated). Each of the male rails 92–95 has an outer side wall 97, an inner side wall 98, and a top wall 99. The side walls 97 and 98 are perpendicular to the top wall and each of the male rails 92–95 is integral with the respective front and rear base sections 103 and 104. Walls 97–99 terminate at an end face 100 which is vertical. Connector rails 90 and 91 each include a top wall 105 and side walls 106 and 107. Lips 108 and 109 project inwardly from the lower ends of the respective side walls. The space within each connector rail is such that it snugly receives one of male rails 92–95 in each end, with the respective walls of each rail engaging the inner surfaces of the respective walls of the connector rail. The height of the opening between the inside surface of wall 105 and the top surfaces of the lips 108 and 109 is the same as the height of wall 97 so each male rail is snugly fit in each connector rail. Advantageously, the length of each connector rail 90 is twice the length of each of male rails 92–95 so the end faces 100 of the respective rails abut each other and the end faces 110 of the connecting rails abut the shoulders 96 when the base is assembled by sliding the male rails into the connector rails. The thickness of the several walls of each connector rail is the same as the depth of the shoulder 96 to provide a smooth joint where the end faces of the connector rails abut the shoulders 96.

The manner of assembling and securing the base sections 103 and 104 together and of securing the seatback 1 to these base sections is substantially similar to that explained for the embodiment of FIG. 1. As is apparent from FIG. 10 it is merely necessary to slip male rails 93 and 94 into one end of the respective connector rails 90 and 91 and slip the male rails 92 and 95 into the opposite ends to firmly seat the respective rails and join the base sections 103 and 104. Then, the connector rails 90 and 91 are welded to the respective male rails which extend into them by the ultrasonic spot welding technique previously explained. Such welding may be done at several locations along the length of each of the overlapping walls of the respective male rails and connector rails. Then, seatback 1 is positioned and welded to the surfaces of side walls 107 of the respective connector rails, simultaneously welding the walls 107 to the walls 98 of the male rails.

Connector rails 90 and 91 can be formed for example, by extruding, by injection molding, or by any other plastic material forming technique. The connector rails 90 and 91 are formed from a plastic material which may be the same as or different from the material of the base sections 103 and 104 and the seat 5. The plastic used to form connector rail sections 90 and 91 can be mixed with a colorant which is either the same as the colorant in the base sections 103 and 104 or can be a contrasting color to provide a desired aesthetic effect.

While the chair of this invention has numerous uses it is used with primary advantage in education institutions where chairs of several different heights may be required. Although the description of the first embodiment of the chair of this invention (FIG. 1) was made with reference to a base structure 2 assembled from a front base piece 3 and a rear base piece 4, with these base pieces joining at the sides of the base, it would require only slight modification to have the base pieces joined respectively at the front and back of the base. In addition, in the second embodiment of FIG. 10 it is contemplated that the male rails 92–95 could instead be female rails in which instance the connectors 90 and 91 would be of the same general configuration as shown at FIG. 10 but of a size sufficiently small to be received within the rails in the same manner that the male rails are received within the female rails of the embodiment of FIG. 1.

While several preferred embodiments of a chair in accordance with the invention have been shown and described in detail, and while a method of making the chair has also been shown and described, it is to be understood that numerous changes can be made without departing from the scope of this invention as set forth herein and as defined in the appended claims.

What is claimed is:

1. A chair base structure comprising, in combination a first unitary plastic material base piece having a pair of spaced apart legs;

a second unitary plastic material base piece having a pair of spaced apart legs;

interfitting means on said first and second base pieces to facilitate assembling said pieces to provide a base having four legs and in which two of the legs diverge relative to the other two legs;

said interfitting means on said first and second base pieces including a rail portion projecting from one side of the first base piece, a rail portion projecting from the other side of the first base piece, a rail portion projecting from one side of the second base piece, and a rail portion projecting from the other side of the second base piece;

said rail portions including two female rail portions and two male rail portions;

each male rail portion comprising an upright outside wall, an upright inside wall spaced from the outside wall, and a top wall integrally joining said inside and outside walls;

each of said female rail portions comprising an outside wall, an inside wall spaced from the outside wall, a top wall integrally joining said inside and outside walls, and wall means extending from the lower edge of said inside wall toward said outside wall, and from the lower edge of said outside wall toward said inside wall;

said male portions being slidably receivable respectively in said female portions, and said wall means engaging bottom edges of said inner and outer walls of the male rail portions to provide beam strength for the rails;

means securing the respective male and female rail portions together;

each of the four legs of the base including a first rigid upright side wall, a second rigid upright side wall integral with and extending at an angle to the first wall;

said walls of the legs being devoid of frangible sections;

a multiplicity of strengthening means for each leg, said strengthening means comprising a multiplicity of rigid webs in spaced apart generally parallel relation to each other along the length of each leg, each of said webs extending transversely between and being integral with said first and second upright walls of a leg, and each of the webs presenting a bottom surface which faces downwardly when the base is in its normal upright position, so that the legs can be severed along the bottoms of selected coplanar webs to provide a base of the desired height with an integral floor engaging glide for supporting the bottom of each leg;

said webs rigidly joining said first and second upright walls against deflection relative to each other to rigidify and strengthen the leg, the bottom web of a leg providing a floor engaging glide, and webs above said bottom web providing strength and rigidity for the leg.

2. A chair base structure according to claim 1 wherein said base pieces are identical to each other, each base piece including a unitary male rail portion, and a unitary female rail portion.

3. A chair base structure according to claim 1 wherein said unitary plastic material base pieces are each of a polypropylene plastic material.

4. A chair base structure according to claim 1 wherein said male rails each have an open bottom; and said wall means extending from the lower edges of said inside and outside walls of each of said female rail portions comprise first and second wall means in spaced apart relation to each other, so that there is an opening into the interior of the male portion of each rail.

5. A chair base structure according to claim 1 wherein said means securing the respective male and female rail portions together includes welds extending through adjacent walls of the male and female rail portions.

6. A chair base structure comprising, in combination a first unitary plastic material base piece having a pair of spaced apart legs;

a second unitary plastic material base piece having a pair of spaced apart legs;

means for joining said base pieces to provide a base having four legs and in which two of the legs diverge relative to the other two legs;

said first and second base pieces including a rail portion projecting from one side of the first base piece, a rail portion projecting from the other side of the first base piece, a rail portion projecting from one side of the second base piece, and a rail portion projecting from the other side of the second base piece;

each of the rail portions including a horizontal wall, and upright side walls projecting in the same direction from the horizontal wall;

said base pieces being oriented with said legs extending downwardly and with said rail portions of the respective base pieces in facing, aligned, adjacent relation with each other so the rail portions at one side of the aligned base pieces form a first rail and the rail portions at the other side of the aligned base pieces form a second rail;

said means for joining said base pieces including first and second connectors joining the rail portions of the respective first and second rails, each connector comprising a horizontal wall, and upright sidewalls projecting in the same direction from the horizontal wall;

the walls of the first connector engaging the horizontal and upright walls of the rail portions of the first rail, and the walls of the second connector engaging the horizontal and upright walls of the rail portions of the second rail, said connectors being of a size to be a close sliding fit with respect to the rail portions; at each rail, one of the joining connector and rail having inwardly projecting wall means extending across and engaging generally horizontal edges of the upright walls of the other of the joining connector and rail to add beam strength to the connected rails;

means securing the first connector to each rail portion of the first rail;

means securing the second connector to each rail portion of the second rail;

each of the four legs of the base including a first rigid upright side wall, a second rigid upright side wall integral with and extending at an angle to the first wall;

said walls of the legs being devoid of frangible sections;

a multiplicity of strengthening means for each leg, said strengthening means comprising a multiplicity of rigid webs in spaced apart generally parallel relation to each other along the length of each leg, each of said webs extending transversely between and being integral with said first and second upright walls of a leg, and each of the webs presenting a bottom surface which faces downwardly when the base is in its normal upright position, so that the legs can be severed along the bottoms of selected coplanar webs to provide a base of the desired height with an integral floor engaging glide for supporting the bottom of each leg;

said webs rigidly joining said first and second upright walls against deflection relative to each other to rigidify and strengthen the leg, the bottom web of a leg providing a floor engaging glide, and webs above said bottom web providing strength and rigidity for the leg.

7. A chair base structure according to claim 6 wherein said base pieces are identical to each other, each base piece including a first unitary male rail portion, and a second unitary male rail portion; and said connectors each comprise a female connector;

said male rail portions of one of said rails extending into said first connector; and said male rail portions of the other of said rails extending into said second connector.

8. A chair base structure according to claim 6 wherein said unitary plastic material base pieces are each of a polypropylene plastic material.

9. A chair base structure according to claim 6 wherein said male and female rails each have an open bottom.

10. A chair base structure according to claim 6 wherein said means securing the first connector to each rail portion of the first rail, and said means securing the second connector to each rail portion of the second rail each comprise welds extending through adjacent walls of the respective connectors and rail portions.

* * * * *